United States Patent [19]

Oppl et al.

[11] Patent Number: 4,958,664

[45] Date of Patent: Sep. 25, 1990

[54] AIR JET LOOM WITH A JACQUARD FRAME AND A VARIABLE DRAWING-IN WIDTH

[75] Inventors: Othmar Oppl, Hergensweiler, Fed. Rep. of Germany; Wilhelm Rupp, Hoerbranz, Austria; Adnan Wahhoud, Bodolz, Fed. Rep. of Germany

[73] Assignee: Lindauer Dornier Gesellschaft GmbH, Lindau/Bodensee, Fed. Rep. of Germany

[21] Appl. No.: 323,441

[22] Filed: Mar. 14, 1989

[30] Foreign Application Priority Data

Mar. 22, 1988 [DE] Fed. Rep. of Germany ..... 3809631

[51] Int. Cl.[5] ..... D03D 47/30; D03D 47/40

[52] U.S. Cl. ..... 139/435.1; 139/194; 139/302

[58] Field of Search ..... 139/435.1, 194, 302

[56] References Cited

U.S. PATENT DOCUMENTS

| | | | |
|---|---|---|---|
| 3,880,198 | 4/1975 | Vermeulen | 139/435 |
| 3,908,710 | 9/1975 | Van Mullekom | 139/194 |
| 4,458,730 | 7/1984 | Dondi Benelli | 139/190 X |
| 4,520,850 | 6/1985 | Cramer et al. | 139/194 |
| 4,644,980 | 2/1987 | Mitsuya et al. | 139/435 |
| 4,732,178 | 3/1988 | Schwarz | 139/435 |

*Primary Examiner*—Andrew M. Falik

*Attorney, Agent, or Firm*—W. G. Fasse; D. H. Kane, Jr.

[57] ABSTRACT

An air jet weaving loom with a jacquard frame wherein harness threads are fed to a reed having a defined drawing-in width. Weft thread insertion devices are arranged on the weft insertion side. A catch side or weft exit side having an adjustable length, is provided with catching elements. The weft thread insertion devices have been arranged on the insertion side of the loom to be movable in the direction of the weft thread insertion for producing woven fabrics with different drawing-in widths.

9 Claims, 5 Drawing Sheets

AIR JET LOOM WITH A JACQUARD FRAME AND A VARIABLE DRAWING-IN WIDTH

FIELD OF THE INVENTION

The invention relates to an air jet weaving loom with a jacquard frame and with a variable drawing-in or weaving width.

BACKGROUND INFORMATION

Air jet weaving looms with a jacquard frame are known. In such looms harness threads are supplied to the reed which has a certain drawing-in width. Weft thread inserting elements are mounted on the weft thread inserting side of the loom. Catch elements for the weft thread are arranged on the weft thread exit side of the loom.

The jacquard frame sits centered vertically exactly above the drawing-in width, thus ensuring a symmetrical orientation or alignment of the harness threads. If the drawing-in width required changing, it was necessary heretofore that the weaving reed was adapted accordingly. Thus, a correspondingly shortened weaving reed was used for a shorter drawing-in width.

Previously, to regain a symmetrical alignment on a narrower weaving reed, one had to shift the entire jacquard machine for achieving a symmetrical distribution of the harness threads even for a reduced drawing-in width. However,, such modifications have the disadvantage of involving considerable constructional effort.

OBJECTS OF THE INVENTION

In view of the foregoing, it is the aim of the invention to achieve the following objects singly or in combination:

to construct an air jet weaving loom with a jacquard of the type described above in such a way, that it is possible to gently draw off the woven fabric while achieving higher weaving frequencies;

to avoid the drawbacks of the prior art, specifically to achieve differing drawing-in widths by simple means which still permit a symmetrical distribution of the harness threads; and to arrange at least the air jet weft thread inserting means and preferably further components on the insertion side in an easily adjustable manner.

SUMMARY OF THE INVENTION

The above objectives have been achieved by the invention in that the devices on the weft thread insertion side of the loom are arranged in a movable manner for adjustment in the direction of the weft thread insertion.

Such an arrangement achieves an operator-friendly movability of the weaving sides, particularly of the insertion side. The following advantages are additionally achieved due to the symmetrical arrangement of the drawing-in width of the weaving loom. The woven fabric runs off symmetrically across the stretcher roller, thereby ensuring a gentle withdrawal of the fabric. By using heddle frames for forming the loom shed, the heddles are symmetrically loaded, thus reducing vibrations of the shafts at higher weaving frequencies.

According to a further embodiment of this invention the main jet holder is constructed to be movable on the insertion side. Additional elements on the insertion side, such as the scissors, the auxiliary selvage apparatus, and the thread clamps are also mounted for adjustment in the insertion direction.

In a preferred embodiment a synchronously driven control shaft extends across the entire width of the machine, because then, all devices to be adjusted on the insertion side and on the exit or catch side can be moved along this control shaft while still assuring that all elements can be actuated synchronously by this control shaft. This feature provides a substantial advantage, because, in previously known machines, the control shaft did not extend across the entire width of the machine and thus, it was relatively difficult to synchronize the various devices on the weaving loom.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
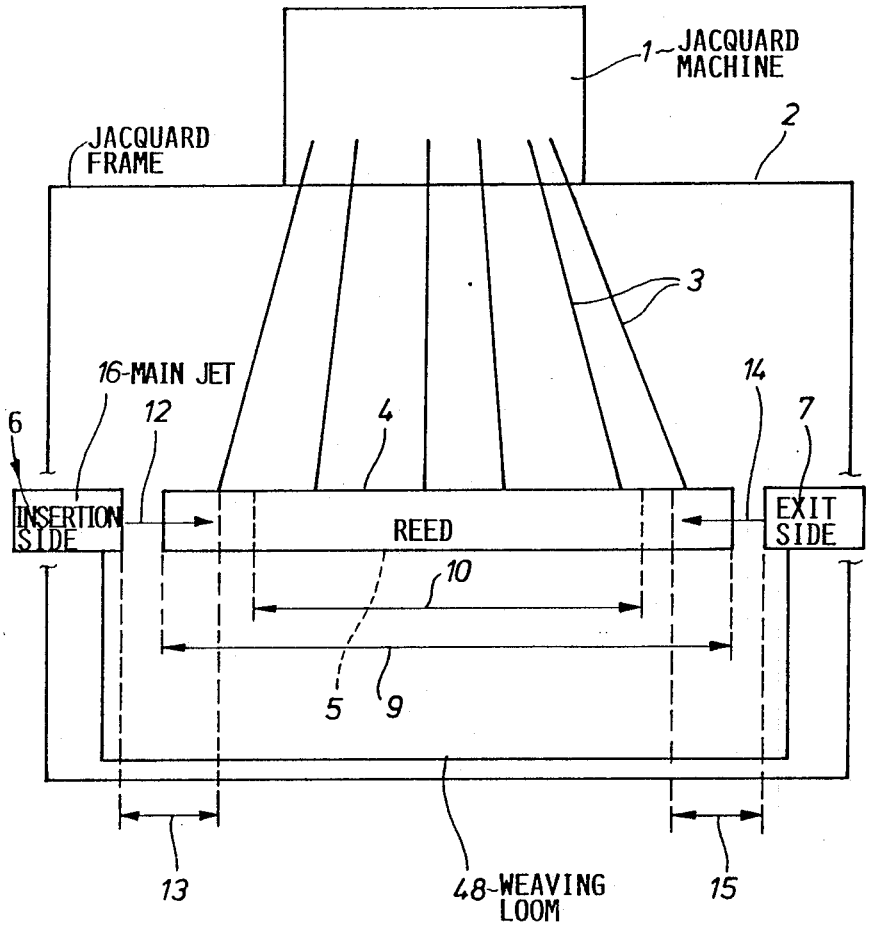
FIG. 1 is a schematic digram of the front view of an air jet weaving loom with a jacquard.

FIG. 1 shows a diagram of a jacquard machine 1 centered on a jacquard frame 2 arranged for cooperation with a weaving loom 48 having air jet means for inserting of the weft thread.

It can be seen in FIG. 1, that the harness threads 3 extending from the jacquard machine 1 are fed symmetrically to the weaving reed 4 of the air jet weaving loom 48.

If one wants to change the drawing-in width of the air jet weaving loom 48, because, for example, a narrower drawing-in width is desired, then one must use a correspondingly shorter weaving reed 5. The longer weaving reed 4 is thus replaced by a shorter weaving reed 5.

According to the invention, the shorter weaving reed 5 is now arranged exactly symmetrical and centered beneath the jacquard machine 1, without having to move the jacquard machine 1 on the jacquard frame 2 for such symmetrical arrangement.

Instead of replacing the longer weaving reed 4 by a shorter weaving reed 5, it is possible in a different embodiment to shorten the weaving reed 4 so that it takes on the position of the weaving reed 5. Because of the shortened length of the weaving reed 5, the insertion side 6 now has to be adjusted in the direction of the arrow 12 and the catch or exit side 7 is adjusted in the direction of the arrow 14.

Prior to the invention it was only known to readjust the catch or exit side 7 in the direction of the arrow 14 to compensate for the difference 15 on the catch or exit side between the shorter weaving reed 5 and the longer weaving reed 4.

According to the invention, the weft thread insertion side 6 is now readjusted in the direction of the arrow 12 to compensate for the difference 13 between the longer weaving reed 4 and the shorter weaving reed 5. This means that the longer drawing-in width 9 on the air jet weaving loom 48 is shortened to a shorter drawing-in width 10 in a symmetrical manner as shown in FIG. 1.

According to the invention the devices arranged on the weft insertion side 6 must be arranged to be adjustable back and forth in the longitudinal insertion direction, namely in the direction of the arrow 12 and in the opposite direction, on the air jet weaving loom 48.

Figure 3:
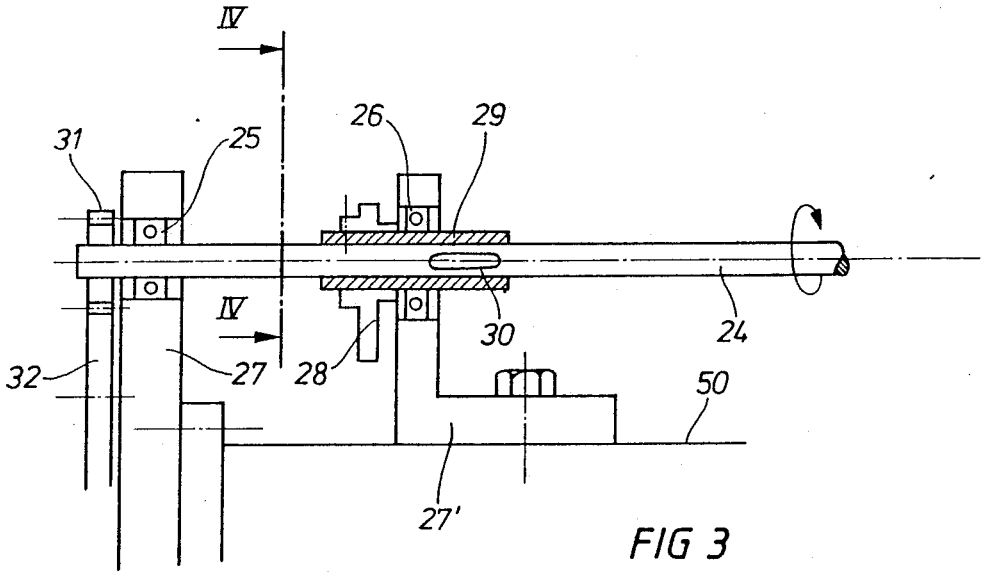
FIG. 3 shows a side view of the control shaft illustrating the scissor eccentrics and the bearing blocks.
Figure 2:
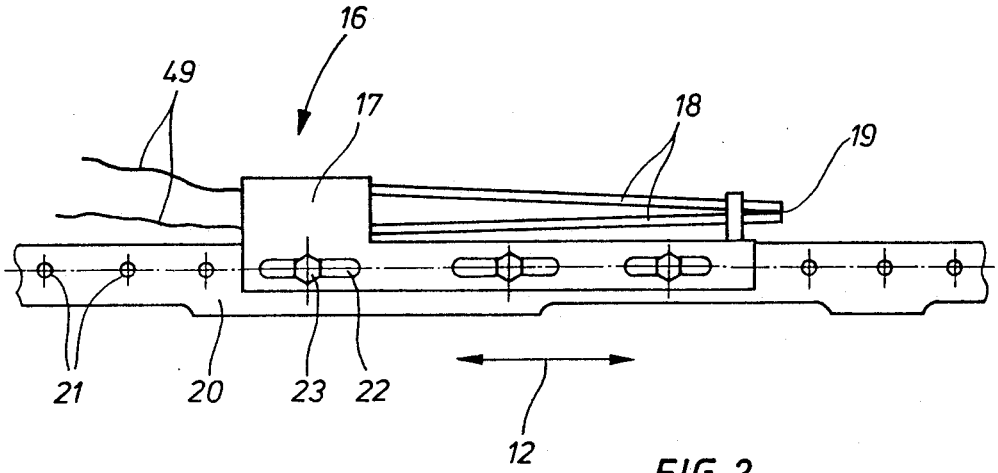
FIG. 2 shows a top view of the main jet arranged on the weft thread insertion side.
Figure 4:
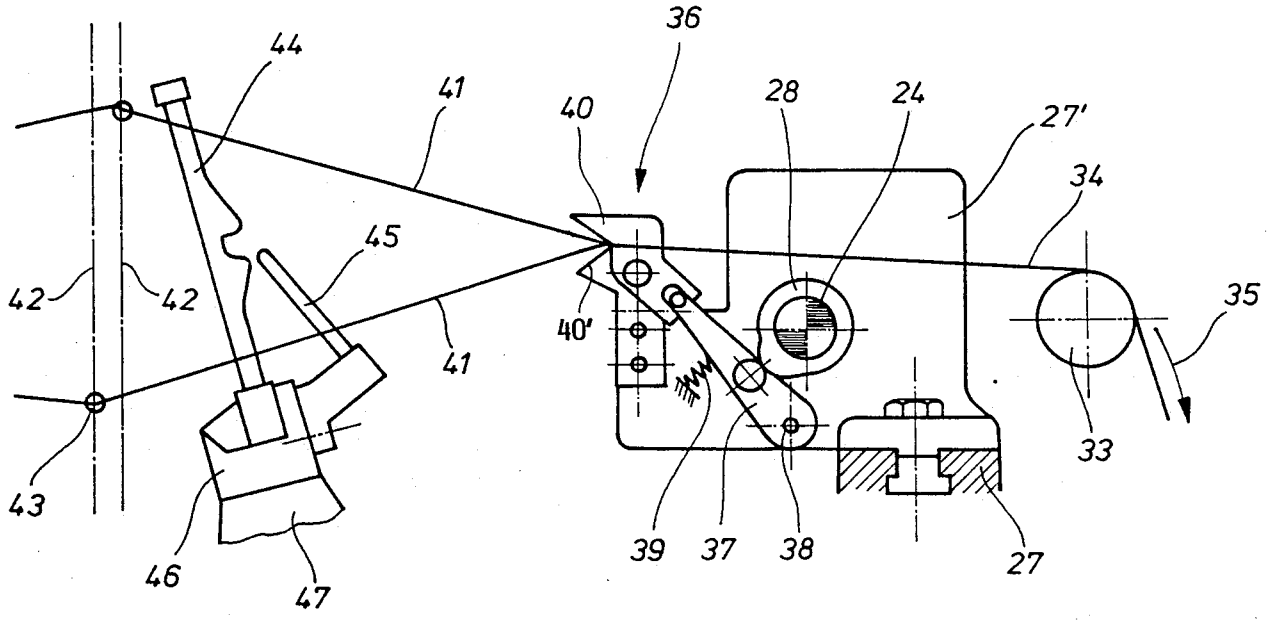
FIG. 4 is a section along line IV—IV in FIG. 3 showing further details.

FIGS. 2 to 4 show further details of the longitudinal adjustment. FIG. 2 shows a main jet 16 comprising a holder 17 in which one or more jet or nozzle tubes 18 are arranged. The tube jets form the thread exit openings on their front end.

The holder 17 is arranged to be longitudinally movable back and forth on the reed guide 20 in the direction of arrows 12. For this purpose, bores 21 are provided in the reed guide 20, into which the corresponding screws 23 can be screwed. Each of the screws 23 passes through the oblong holes 22 arranged in the longitudinal direction in the holder 17, so that the entire holder 17 is movable on the reed guide 20 as determined by the length of the oblong hole 22. However, in order to provide larger adjustment ranges, the screws 23 can be completely removed and screwed into the other bores 21 along the length of the reed guide 20.

As shown on the left-hand side of FIG. 2 the weft threads 49 are fed to the main jet 16.

FIG. 3 shows further details of the synchronous drive of the individual elements. Here it is rather important that the control shaft 24 extends across the entire width of the air jet weaving loom 48. This feature offers the substantial advantage that all functional elements of the insertion side 6 and of ,the catch or exit side 7 are movable along this control shaft 24 while still always being actuated synchronously by this control or drive shaft 24.

These advantages cannot be obtained by the prior art, because previously, only a relatively short control shaft was provided on the insertion side. The conventional shorter control or drive shaft did not allow the functional elements arranged on the insertion side to be moved continuously along the drive shaft.

FIG. 3 shows the control shaft 24 rotatably supported by the bearings 25, 26 on the bearing blocks 27 and 27' on the frame member 50 of the air jet weaving loom. The control shaft 24 is rotated or driven by a toothed gear 31, 32.

FIG. 3 shows further, as an example, a movable or position adjustable scissors drive in the form of an eccentric or cam 28. All other functional elements on the insertion side can be actuated by equally acting movable elements and are thus adjustable.

According to FIG. 3, the eccentric or cam 28 for actuating the scissors 36 shown in FIG. 4, is rigidly connected to a bushing 29 to rotate with the bushing, which slides on a key 30 in the longitudinal direction along the control shaft 24. Further details of the drive for the scissors 36 are shown in FIG. 4.

Referring to FIG. 4, the control shaft 24 is rotatably supported by the bearing block 27'. The cam or eccentric 28 acts on a pivot lever 37 mounted at one end in a bearing 38 journalled to the bearing block 27'. The scissors 36 are spring actuated by the pivot lever 37, which is spring biased by spring 39 to close the scissors and hence cut the warp threads 41 when the cam or the eccentric 28 releases the lever 37. One scissors cutter 40 is pivotally mounted for actuation by the spring 39, while the other cutter 40' is mounted in a fixed position on the bearing block 27'. In accordance with the illustration in FIG. 3, the entire scissors 36 is movable along the control shaft 24 perpendicular to the plane defined by the drawing sheet of FIG. 4.

Furthermore, it can be seen that the warp threads 41 are guided through the heddle eyes 43 of the heddles 42 which run parallel to and are evenly spaced from each other. The weft thread insertion system, comprising a profile weaving reed 44 arranged for cooperation with weft thread transport nozzles 45, is arranged between the upper and the lower warp threads 41. The just mentioned parts are mounted on a reed guide 46, which is fixed to a reed support 47.

The finished fabric 34 is drawn off by the stretcher or take-up roller 33 in the direction of the arrow 35.

It is important to this invention that the weft thread insertion side is arranged in a movable adjustable manner in the direction of arrows 12, according to FIG. 1, so that a symmetrical arrangement of the drawing-in width is ensured for use in jacquard machines. This symmetry is possible because now both differences 13 and 15 shown in FIG. 1 can be compensated. Thus, it is assured that the fabric runs symmetrically across the rotary stretcher or take-up roller 33, for gently drawing-off the woven fabric due to the symmetrical alignment of the harness threads or cords 3.

If one combines a jacquard machine 1 with heddle shafts, not shown here, there is the added advantage that the heddle shafts are symmetrically stressed. This allows higher weaving frequencies to be attained because, due to the symmetrical arrangement, vibrations of the shafts are avoided.

Figure 5:
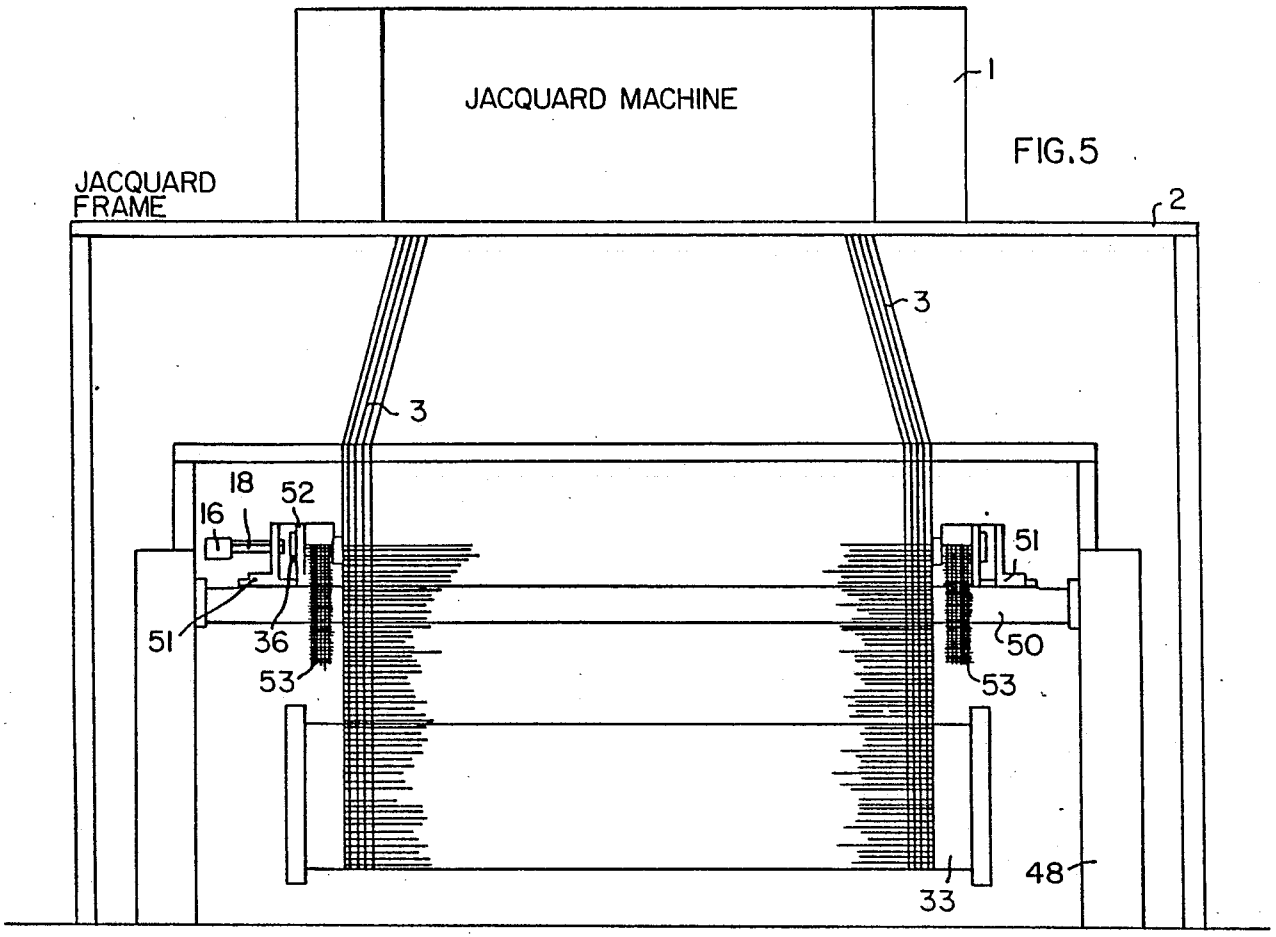
FIG. 5 is a view similar to that of FIG. 1, showing an auxiliary selvage apparatus.
Figure 6:
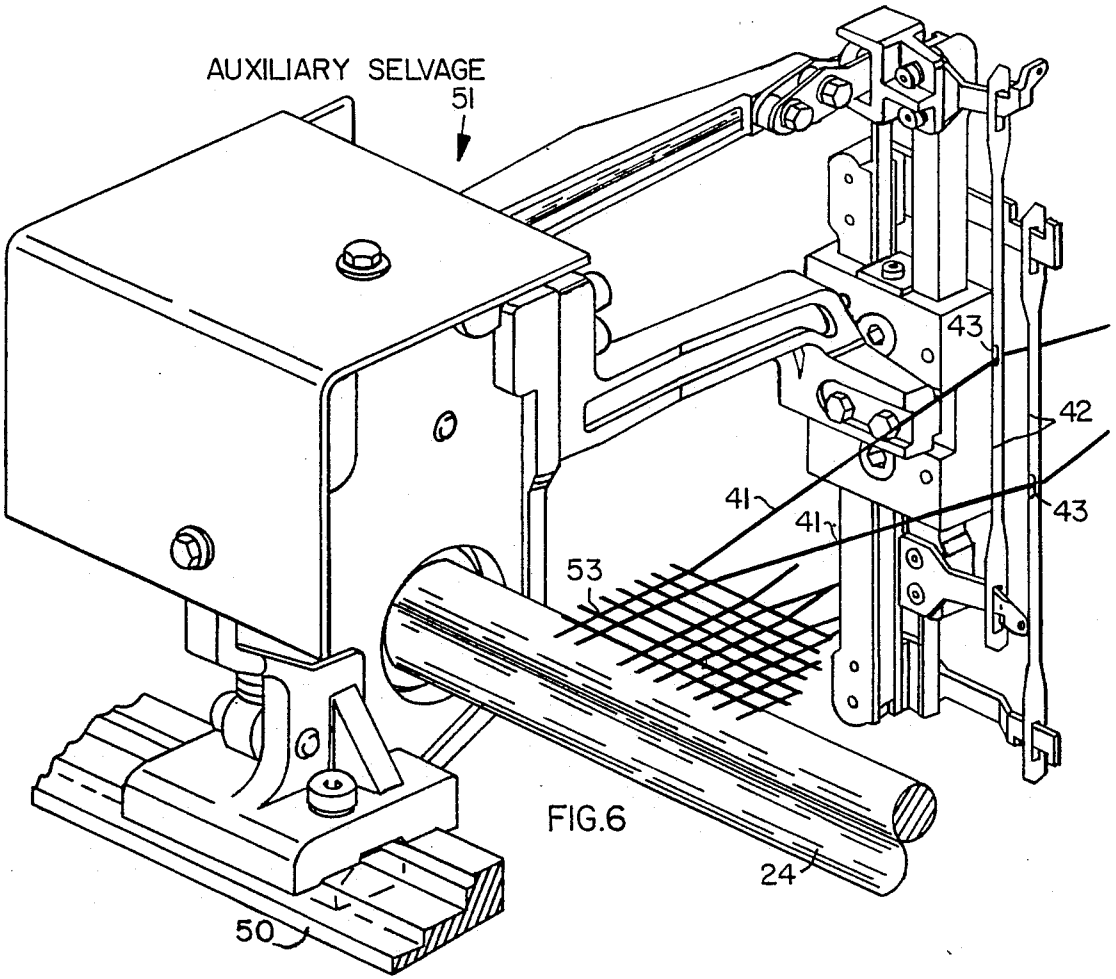
FIG. 6 is a perspective view of an auxiliary selvage apparatus.

FIG. 5 is a front view of the present weaving loom 48 showing schematically the auxiliary selvage apparatus 51 movably mounted on the frame member 50 on each side of the loom. FIG. 5 also shows the weft thread clamp 52 and the scissors 36. FIG. 6 shows a perspective view of the auxiliary selvage apparatus 51, which forms a selvage 53.

Although the invention has been described with reference to specific example embodiments it will be appreciated that it is intended to cover all modifications and equivalents within the scope of the appended claims.

What we claim is:

1. An air jet weaving loom comprising changeable length reed means (4, 5) arranged centrally in said weaving loom, a jacquard machine (1) arranged above and symmetrically to a center of said reed means, said jacquard machine providing harness threads (3) to a centered and symmetric drawing-in width of said reed means, weft thread insertion means on an insertion side of said loom for inserting a weft thread into a loom shed, position adjustable weft thread catch means on an exit side of said air jet weaving loom, means for adjusting the position of said weft thread insertion means back and forth in the weft thread insertion direction (12) on the air jet weaving loom (48), so that adjustments on said insertion side and on said exit side together maintain said drawing-in width centered and symmetric independently of a changed length of said reed means, said air jet weaving loom further comprising weft thread scissors (36), auxiliary selvage means (51) for forming a selvage (53), a weft thread clamp, and means for movably and adjustably mounting said scissors, said auxiliary selvage means, and said weft thread clamp on said weft thread insertion side for maintaining said drawing-in width centered and symmetric.

2. The air jet weaving loom of claim 1, wherein said weft thread insertion means comprise a main jet, and wherein said means for adjusting comprise a holder (17) for said main jet (16) and means for positioning said holder back and forth along said weft thread insertion direction.

3. The air jet weaving loom of claim 1, wherein said means for adjusting the position of said weft thread insertion means comprise a synchronously driven control shaft (24) mounted across the entire width of said loom, said means for adjusting being operatively mounted on said control shaft, said weft thread catch means being also arranged for adjustment along said control shaft (24), whereby all drivable means connected to said control shaft on both sides of said loom are actuated synchronously by said control shaft so that a uniform timing is maintained.

4. The air jet weaving loom of claim 3, further comprising eccentric drive means for actuating said scissors (36), said auxiliary selvage means, and said thread clamp, bushing means for mounting said eccentric drive means on said control shaft for rotation with said control shaft, and means for mounting said bushing means on said control shaft to rotate with said control shaft and to permit an axial movement of said bushing means relative to said control shaft.

5. The air jet weaving loom of claim 4, wherein said means for mounting said bushing means on said control shaft comprise groove and key means permitting said axial movement of said bushing means in the longitudinal direction of said control shaft (24) within the length of said key means.

6. An air jet loom comprising reed means for beating-up weft threads, a jacquard machine (1) for supplying harness threads (3) to a centered and symmetric drawing-in width of said reed means, position adjustable first thread handling means on a weft thread insertion side of said air jet loom, position adjustable second thread handling means on a weft thread exit side of said air jet loom, said first and second thread handling means being adjustable toward and away from each other in a weft thread insertion direction for maintaining said drawing-in width centered and symmetric relative to a machine central plane without having to move said jacquard machine (1) relative to said air jet loom, and wherein said first and second thread handling means comprise a common control shaft (24).

7. The air jet loom of claim 6, wherein said first and second thread handling means comprise auxiliary selvage forming means.

8. The air jet loom of claim 6, wherein said first thread handling means comprise air jet nozzles for inserting a weft thread into a loom shed, and wherein said second thread handling means comprise weft thread catch means for pulling a weft thread straight.

9. The air jet loom of claim 6, wherein said first thread handling means comprise thread scissors (36) and a thread clamp (52).

* * * * *

UNITED STATES PATENT AND TRADEMARK OFFICE

CERTIFICATE OF CORRECTION

PATENT NO. : B1 4,958,664

DATED : May 14, 1996

INVENTOR(S) : Oppl et al.

It is certified that error appears in the above-identified patent and that said Letters Patent is hereby corrected as shown below:

Col. 2, line 8, replace "cam eccentric" by --cam or eccentric--;

line 25, after "inserted." insert --Reference numeral 27 was changed to 50.--;

line 36, (Claim 10), replace "jacquare" by --jacquard--;

line 59, (Claim 10), replace "frist" by --first--.

Col. 3, line 9, (Claim 11), replace "shaft(24)" by --shaft (24)--.

Signed and Sealed this

Fifth Day of November, 1996

Bruce Lehman

*Attest:*

BRUCE LEHMAN

*Attesting Officer*

*Commissioner of Patents and Trademarks*

US004958664B1

REEXAMINATION CERTIFICATE (2878th)

United States Patent [19] [11] B1 4,958,664

Oppl et al. [45] Certificate Issued May 14, 1996

[54] AIR JET LOOM WITH A JACQUARD FRAME AND A VARIABLE DRAWING-IN WIDTH

[75] Inventors: Othmar Oppl, Hergensweiler, Germany; Wihelm Rupp, Hoerbranz, Austria; Adnan Wahhoud, Bodolz, Germany

[73] Assignee: Lindauer Dornier Gesellschaft M.B.H., Lindau/Bodensee, Germany

Reexamination Request:
No. 90/003,661, Dec. 14, 1994

Reexamination Certificate for:

| | |
|---|---|
| Patent No.: | **4,958,664** |
| Issued: | **Sep. 25, 1990** |
| Appl. No.: | **323,441** |
| Filed: | **Mar. 14, 1989** |

[30] Foreign Application Priority Data

Mar. 22, 1988 [DE] Germany ..... 3809631

[51] Int. Cl.[6] ..... D03D 47/30; D03D 37/40

[52] U.S. Cl. ..... 139/435.1; 139/194; 139/302

[58] Field of Search ..... 139/435.1, 194, 139/302

[56] References Cited

U.S. PATENT DOCUMENTS

| | | |
|---|---|---|
| 1,600,069 | 9/1926 | Seckler . |
| 3,451,440 | 6/1969 | Golobart . |
| 3,621,886 | 11/1971 | Van Mullekom . |
| 3,943,978 | 3/1976 | Jindra . |
| 3,951,177 | 4/1976 | Santucci . |
| 4,212,330 | 7/1980 | Van Donk et al. . |
| 4,326,565 | 4/1982 | Van Mullekom . |
| 4,353,396 | 10/1982 | Suzuki et al. . |
| 4,489,762 | 12/1984 | Wazenegger . |
| 4,669,514 | 6/1987 | Manders . |
| 4,777,986 | 10/1988 | Brochier . |
| 4,905,740 | 3/1990 | Verclyte . |

FOREIGN PATENT DOCUMENTS

| | | |
|---|---|---|
| 0087519 | 9/1983 | European Pat. Off. . |
| 61-225354 | 10/1986 | Japan . |
| 1079692 | 8/1967 | United Kingdom . |
| 1209589 | 10/1970 | United Kingdom . |
| WO79/00759 | 10/1979 | WIPO . |

OTHER PUBLICATIONS

Picanol brochure "Technical Summary of the Picanol Grip Tronic, High Performance Flexible Rapier Weaving Machine" (no dated supplied).

Dornier catalog "The Dornier Weaving Machine: The Optimum Tool for the Creative Weaver" (no date supplied).

*Primary Examiner*—Andrew M. Falik

[57] ABSTRACT

An air jet weaving loom with a jacquard frame wherein harness threads are fed to a reed having a defined drawing-in width. Weft thread insertion devices are arranged on the weft insertion side. A catch side or weft exit side having an adjustable length, is provided with catching elements. The weft thread insertion devices have been arranged on the insertion side of the loom to be movable in the direction of the weft thread insertion for producing woven fabrics with different drawing-in widths.

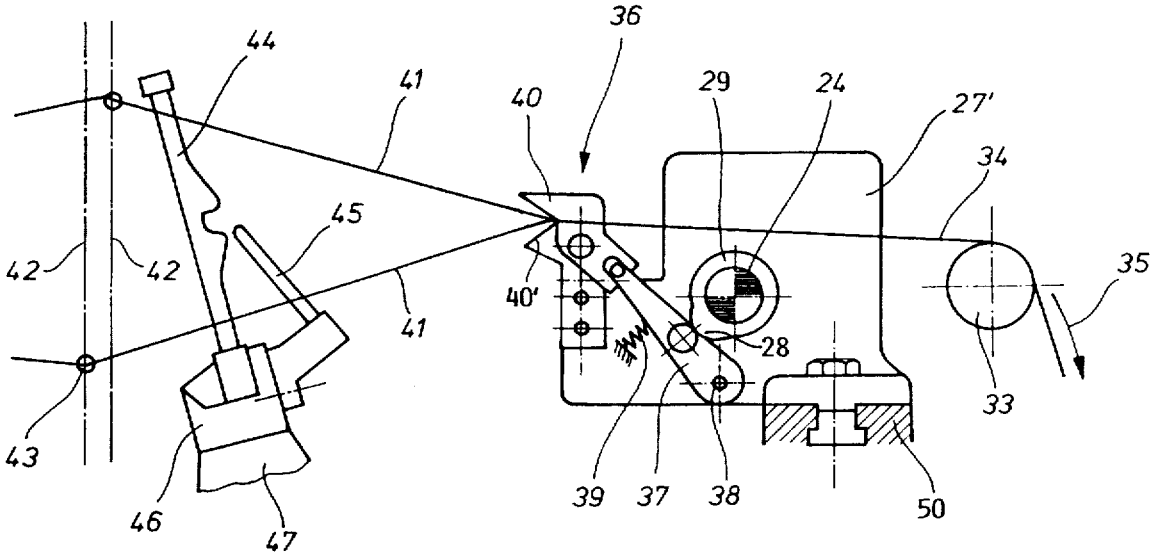

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

+c ONLY THOSE PARAGRAPHS OF THE SPECIFICATION AFFECTED BY AMENDMENT ARE PRINTED HEREIN.

Column 2, lines 54–61:

Instead of replacing the longer weaving reed 4 by a shorter weaving reed 5, it is possible in a different embodiment to shorten the weaving reed 4 so that it takes on the position of the weaving reed 5. Because of the shortened length of the weaving reed 5, the insertion side 6 now has to be adjusted in the direction of the arrow 12 and the [catch or exit side 7] *weft catcher 7 on the exit side* is adjusted in the direction of the arrow 14.

Column 2 lines 62–66:

Prior to the invention it was only known to readjust the [catch or exit side 7] *weft catcher 7 on the exit side* in the direction of the arrow 14 to compensate for the difference 15 on the [catch or exit side] *weft catcher 7 on the exit side* between the shorter weaving reed 5 and the longer weaving reed 4.

Column 2 line 67 to Column 3, line 5:

According to the invention, the weft thread insertion side 6 is now readjusted in the direction of the arrow 12 to compensate for the difference 13 between the longer weaving reed 4 and the shorter weaving reed 5. This means that the longer drawing-in width 9 on the air jet weaving loom 48 is shortened to a shorter drawing-in width 10 in a symmetrical manner as shown in FIG. 1[.], *dependent on the shorter width of the reed 5.*

Column 3 lines 11–15:

FIGS. 2 to 4 show further details of the longitudinal adjustment. FIG. 2 shows a main jet 16 comprising a holder 17 in which one or more jet or nozzle tubes 18 are arranged. The tube jets form the thread exit opening *19* on their front end.

Column 3 lines 30–38:

FIG. 3 shows further details of the synchronous drive of the individual elements. Here it is rather important that the control shaft 24 extends across the entire width of the air jet weaving loom 48. This feature offers the substantial advantage that all functional elements of the insertion side 6 and of the [catch or exit side 7] *catcher 7 on the exit side* are movable along this control shaft 24 while still always being actuated synchronously by this control or drive shaft 24.

Column 3 lines 55–60:

According to FIG. 3, the eccentric or cam 28 for actuating [the] *weft* scissors 36 shown in FIG. 4, is rigidly connected to a bushing 29 to rotate with the bushing, which slides on a key 30 in the longitudinal direction along the control shaft 24. Further details of the drive for the scissors 36 are shown in FIG. 4.

Column 3 line 61 to Column 4 line 6:

Referring to FIG. 4, the control shaft 24 is rotatably supported by the bearing block 27'. The cam eccentric 28 acts on a pivot lever 37 mounted at one end in a bearing 38 journalled to the bearing block 27'. The scissors 36 are spring actuated by the pivot lever 37, which is spring biased by spring 39 to close the scissors and hence cut the [warp] *weft* threads [41] *49* when the cam or the eccentric 28 releases the lever 37. One scissors cutter 40 is pivotally mounted for actuation by the spring 39, while the other cutter 40' is mounted in a fixed position on the bearing block 27'. In accordance with the illustration in FIG. 3, the entire scissors 36 is movable along the control shaft 24 perpendicular to the plane defined by the drawing sheet of FIG. 4.

The drawing figures have been changed as follows:

Reference numeral 28 was changed to 29 and a new 28 was inserted to show the eccentric portion on the bushing 29. A lead line between the cam projection of the cam drive (29) and reference number (28) has been inserted.

AS A RESULT OF REEXAMINATION, IT HAS BEEN DETERMINED THAT:

Claims 1–8 and 9 are cancelled.

New claims 10–12 and 13 are added and determined to be patentable.

*10. An air jet loom comprising reed means for beating-up weft threads, a jacquare machine (1) for supplying harness threads (3) to a centered and symmetric drawing-in width of said reed means, position adjustable first thread handling means on a weft thread insertion side of said air jet loom, position adjustable second thread handling means on a weft thread exit side of said air jet loom, said first and second thread handling means being adjustable toward and away from each other in a weft thread insertion direction for maintaining said drawing-in width centered and symmetric relative to a machine central plane without having to move said jacquard machine (1) relative to said air jet loom, and wherein said first and second thread handling means comprise a common control shaft (24) rotatably mounted to extend across the entire width of said air jet loom, said first thread handling means including weft thread scissors (36), a first selvage forming means (51), a weft thread clamp (52), and an air jet nozzle device (16, 17, 18, 19), said second thread handling means including a second selvage forming means (51) and a weft thread catch means (7), said air jet loom further comprising position adjusting means for said first and second thread handling means, said position adjusting means comprising a synchronous drive (31, 32) connected to said common control shaft (24) for driving said frist and second selvage forming means (51), said weft thread clamp (52), and said weft thread scissors (36) in synchronism toward and away from each other, said common control shaft (24) comprising an eccentric drive means (28) for actuating said weft thread scissors (36), a bushing means (29) mounting said eccentric drive means (28) on said common control shaft (24) for rotation with said common control shaft (24), and means (30) for mounting said bushing means (29) on said common control shaft (24)*

*to rotate with said common control shaft and to permit an axial movement of said bushing means (29) relative to said common control shaft, whereby said synchronism is enforced by said common control shaft (24) on both sides of said loom so that a uniform timing is maintained.*

*11. The air jet loom of claim 10, wherein said means (30) for mounting said bushing means (29) on said common control shaft(24) comprise groove and key means (30) permitting said axial movement of said bushing means (29) in a longitudinal direction of said common control shaft (24) within the length of said key means.*

*12. The air jet loom of claim 10, wherein said first and second selvage forming means are auxiliary selvage forming means (51).*

*13. The air jet loom of claim 10, wherein said air jet nozzle device of said first thread handling means comprises air jet nozzles for inserting a weft thread into a loom shed, and wherein said weft thread catch means (7) of said second thread handling means is adapted for pulling a weft thread straight.*

* * * * *